US007374020B2

(12) United States Patent
Smith et al.

(10) Patent No.: US 7,374,020 B2
(45) Date of Patent: May 20, 2008

(54) ENERGY EFFICIENT ELEVATOR SYSTEM

(75) Inventors: Rory Smith, El Cajon, CA (US); Richard Peters, Great Kingshill (GB); Lutfi Al-Sharif, London (GB)

(73) Assignee: ThyssenKrupp Elevator Capital Corporation, Troy, MI (US)

( * ) Notice: Subject to any disclaimer, the term of this patent is extended or adjusted under 35 U.S.C. 154(b) by 528 days.

(21) Appl. No.: 10/788,854

(22) Filed: Feb. 27, 2004

(65) Prior Publication Data

US 2005/0189180 A1 Sep. 1, 2005

(51) Int. Cl.
*B66B 1/06* (2006.01)

(52) U.S. Cl. ..... 187/289; 187/296

(58) Field of Classification Search ..... 187/247, 187/277, 293–297, 290, 289, 276
See application file for complete search history.

(56) References Cited

U.S. PATENT DOCUMENTS 4,284,175 A * 8/1981 Ishii et al. ..... 187/289
4,479,565 A * 10/1984 Nomura ..... 187/296
4,503,938 A * 3/1985 Nomura ..... 187/296
4,700,811 A * 10/1987 Evin ..... 187/293
4,721,188 A * 1/1988 Araki et al. ..... 187/296
5,241,255 A * 8/1993 Oshima et al. ..... 318/801
5,893,432 A * 4/1999 Nguyen et al. ..... 187/290

* cited by examiner

*Primary Examiner*—Jonathan Salata
(74) *Attorney, Agent, or Firm*—Frost Brown Todd LLC

(57) ABSTRACT

The invention is directed to an apparatus and methods for enhancing the energy efficiency of a variable speed drive (VSD) used to control an elevator by disconnecting the VSD from the AC power supply grid when the elevator is idle and reconnecting the VSD when the elevator becomes active. One embodiment of the invention includes an alternating current power supply grid, one or more variable speed drives, contactors connected between the alternating current power supply grid and the variable speed drive(s) that are used to connect or disconnect the variable speed drive(s) from the alternating current power supply grid, and, a control system that controls the contactors. The contactors may include a coil which is powered by the control system to either connect or disconnect the VSDs and the AC power supply grid.

20 Claims, 1 Drawing Sheet

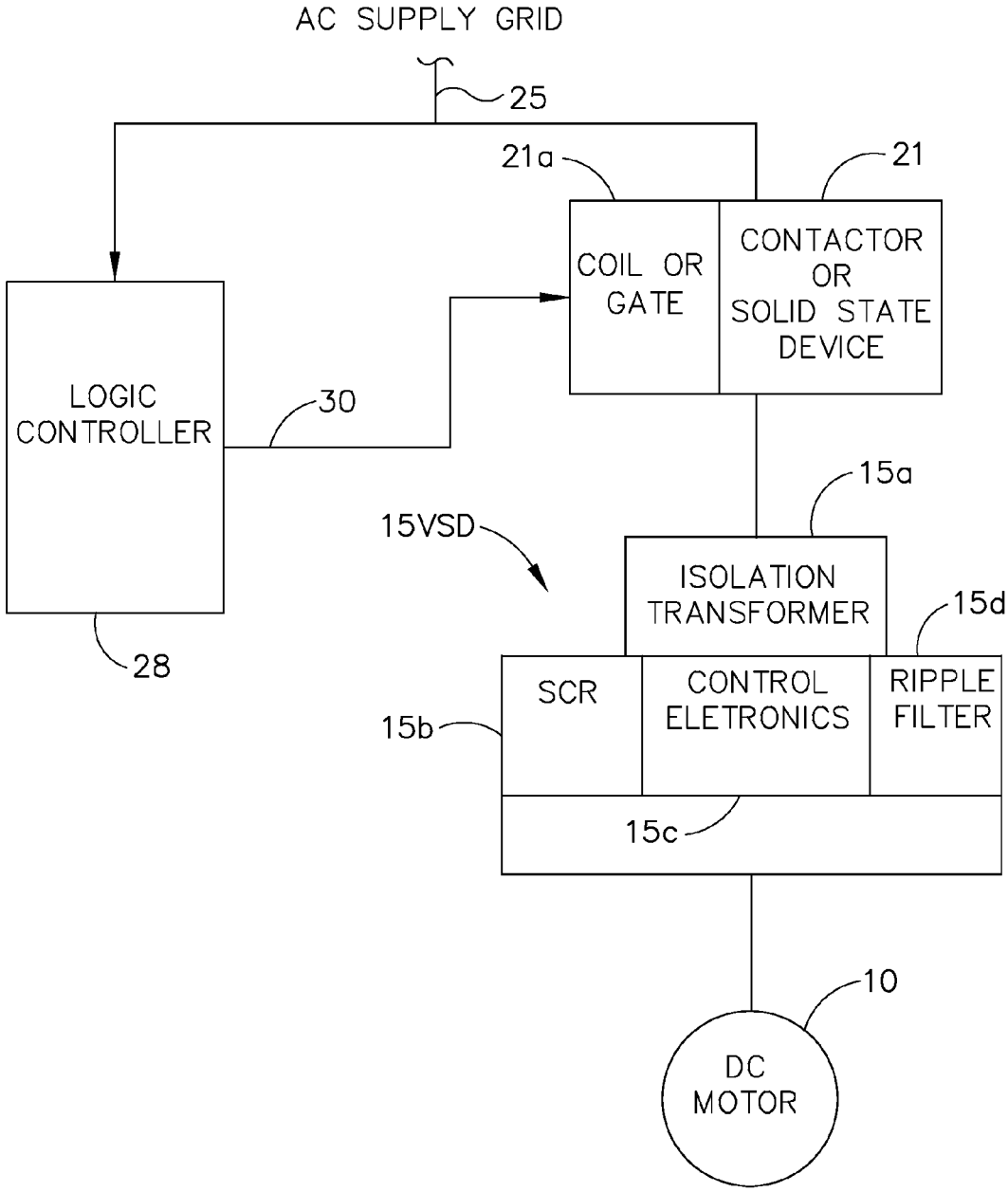
AC SUPPLY GRID
25
21a
21
COIL OR GATE
CONTACTOR OR SOLID STATE DEVICE
LOGIC CONTROLLER
30
28
15a
15VSD
ISOLATION TRANSFORMER
15d
SCR
CONTROL ELETRONICS
RIPPLE FILTER
15b
15c
10
DC MOTOR

ENERGY EFFICIENT ELEVATOR SYSTEM

BACKGROUND

Virtually all of the high speed elevators installed prior to 1975 used direct current (DC) motors. The source of the direct current was typically a motor-generator (MG) set. The alternating current (AC) motor of the MG set was connected to an AC supply grid powered by the three phase AC supply of the building.

Between 1975 and the early 1990's the majority of new high speed elevators were manufactured with DC motors supplied by a variable speed drive (VSD) that consisted of an isolation transformer, silicon controlled rectifiers, control electronics, and a ripple filter. This same VSD system was also used to modernize thousands of existing elevators. The existing DC motor was retained and the MG was replaced by the VSD.

The silicon controlled rectifier variable speed drive (SCR VSD) is considered to be much more energy efficient than the MG set because the MG set was turning even if the elevator was stopped. However, the SCR VSD wastes significant energy because the isolation transformer was always connected to the power supply grid. Additionally, the SCR VSD supplied standby power (approximately 50% of running current) to the motor field. This power was typically supplied 24 hours a day, 365 days a year. The only time the VSD was not connected and consuming power was during maintenance.

SUMMARY OF THE INVENTION

The invention is directed to an apparatus and methods for enhancing the energy efficiency of a variable speed drive 15 (VSD) used to control an elevator by disconnecting the VSD from the AC power supply grid when the elevator is idle and reconnecting the VSD when the elevator becomes active. One embodiment of the invention comprises an alternating current power supply grid, one or more variable speed drives, contactors connected between the alternating current power supply grid and the variable speed drive(s) that are used to connect or disconnect the variable speed drive(s) from the alternating current power supply grid, and, a control system that controls the contactors. The invention may be powered by a three phase AC power source. The variable speed drives may comprise an isolation transformer having a line side, one or more silicon controlled rectifiers, a control circuit and a ripple filter and the contactor(s) could be connected to the line side of the isolation transformer of each variable speed drive. The contactors may comprise a coil which is powered by the control system to connect or disconnect the VSDs and the AC power supply grid. Solid-state devices may be used instead of contactors, and the control system may control the gates of the solid-state devices to connect or disconnect the VSDs and the AC power supply grid. In one embodiment, the control system disconnects VSDs that are idle for a fixed time period, such as 60 seconds.

BRIEF DESCRIPTION OF THE DRAWINGS

FIG. 1 is a block diagram depicting an embodiment of the present invention.

DETAILED DESCRIPTION OF THE INVENTION

The invention enhances the energy efficiency of variable speed drives (VSD) used to control elevators by disconnecting the VSDs from the AC power supply grid when the elevators are idle and connecting the VSDs to the AC power supply grid when the elevators are or become active.

In a preferred embodiment, an elevator is powered by a DC motor 10 controlled by a variable speed drive 15 (VSD) having an isolation transformer 15*a*, a plurality of silicon controlled rectifiers 15*b*, control electronics 15*c*, and a ripple filter 15*d*. A three phase contactor 21 is connected to the line side of the isolation transformer of the VSD 15 and the AC supply grid 25. which may be a three phase AC power source. A control system, such as logic controller 28 is connected to the AC supply grid 25 and has an output device 30 connected to the three phase contactor 21 that controls the three phase contactor to disconnect the VSD 15 from an AC supply grid 25 when elevator service is not required. When the control system 28 supplies power to the coil 21 a of the contactor 21, the contactor 21 connects the VSD 15 to the AC supply grid 25. When the control system 28 does not supply power to the coil of the contactor 21, the contactor 21 disconnects the VSD 15 from the AC supply grid 25. The control system 28 remains connected to and continues to be powered by the AC supply grid 25 even when the VSD 15 is disconnected from the AC supply grid.

In an alternate embodiment, the contactor is replaced with a solid state device such as a switch. In this case, the control system has an output device that controls the gate of the solid state device.

The control system may include software, firmware or hardware to connect or disconnect the VSD from the AC supply grid based upon demand for an elevator. In one embodiment, the VSD is disabled if there is no demand for an elevator for a fixed period of time, such as 60 seconds. Since the VSD executes a startup sequence and self diagnostic routine that takes several seconds each time the VSD is connected or reconnected to the AC supply grid, the VSD should not be disabled each time the elevator stops at a floor.

It is envisioned that a typical elevator would have the VSD disabled over 12 hours a day during the work week and for a much longer time in periods of light use, such as weekends and holidays. A typical elevator consumes 1 to 2 kilowatts when on standby which can be saved with this invention.

What is claimed is:

1. An energy efficient elevator system comprising:

an alternating current power supply grid;

at least one variable speed drive for driving an elevator motor;

at least one connector connected between the alternating current power supply grid and the at least one variable speed drive, and which selectively disconnects the at least one variable speed drive from the alternating current power supply grid; and a control system connected to the alternating current power supply grid, the control system having an output device connected to the at least one connector and controlling the at least one connector to selectively disconnect the at least one variable speed drive from the alternating current power supply when the at least one variable speed drive has been idle for a predetermined period of time.

2. The energy efficient elevator system of claim 1 comprising a three phase AC power source.

3. The energy efficient elevator system of claim 1 wherein:

the at least one variable speed drive comprises an isolation transformer having a line side, at least one silicon controlled rectifier, a control circuit, and a ripple filter, wherein the at least one connector is connected to the line side of the isolation transformer of the at least one variable speed drive.

4. The energy efficient elevator system of claim 1, wherein the connector is a solid state device.

5. The energy efficient elevator system of claim 4, wherein the solid state device is a switch.

6. The energy efficient elevator system of claim 1, wherein the at least one variable speed drive is disconnected from all power sources.

7. The energy efficient elevator system of claim 6, wherein the at least one variable speed drive is disconnected from all power sources for a predetermined interval of time.

8. The energy efficient elevator system of claim 1, wherein the control system controls the at least one connector to disconnect the at least one variable speed drive when the at least one variable speed drive is idle for at least 60 seconds.

9. An energy efficient elevator system comprising:

an alternating current power supply grid;

at least one variable speed drive for driving an elevator motor;

at least one connector connected between the alternating current power supply grid and the at least one variable speed drive, and which selectively disconnects the at least one variable speed drive from the alternating current power supply grid for an interval of time; and a control system connected to the alternating current power supply grid, the control system having an output device connected to the at least one connector and controlling the at least one connector to disconnect the at least one variable speed drive from the alternating current power supply grid for the interval of time when the at least one variable speed drive has been idle for a predetermined period of time.

10. The energy efficient elevator system of claim 9 wherein:

the at least one connector comprises a gate; and the control system output device controls the gate to connect the at least one variable speed drive to the alternating current power supply grid and controls the gate to disconnect the at least one variable speed drive from the alternating current power supply grid.

11. The energy efficient elevator system of claim 9 wherein the control system controls the at least one connector to disconnect the at least one variable speed drive when the at least one variable speed drive is idle for at least 60 seconds.

12. The energy efficient elevator system of claim 1, wherein the connector is a contactor.

13. The energy efficient elevator system of claim 9, wherein the interval of time is one of a plurality of intervals of time within a twenty-four hour period.

14. The energy efficient elevator system of claim 9, wherein the control system disconnects the at least one connector after a period of system inactivity.

15. The energy efficient elevator system of claim 14, wherein the control system reconnects the at least one connector upon user initiation.

16. The energy efficient elevator system of claim 14, wherein the control system reconnects the at least one connector after the duration of the interval of time.

17. The energy efficient elevator system of claim 16, wherein the control system is configured to disconnect the at least one variable speed drive from all sources of power when the at least one variable speed drive is idle for a predetermined period of time.

18. The energy efficient elevator system of claim 16, wherein the variable speed drive is disconnected from the alternating current power supply grid and a direct current power supply.

19. An energy efficient elevator system comprising:

an alternating current power supply grid;

at least one variable speed drive for driving an elevator motor;

at least one connector connected between the alternating current power supply grid and the at least one variable speed drive, and which selectively disconnects the at least one variable speed drive from all sources of power; and a control system connected to the alternating current power supply grid, the control system having an output device connected to the at least one connector and controlling the at least one connector to disconnect the at least one variable speed drive from all sources of power when the at least one variable speed drive has been idle for a predetermined period of time.

20. The energy efficient elevator system of claim 19, wherein the predetermined period of time is at least 60 seconds.

* * * * *